US007351084B2

(12) United States Patent
Ohtaka et al.

(10) Patent No.: US 7,351,084 B2
(45) **Date of Patent: *Apr. 1, 2008**

(54) ELECTRICAL CONNECTOR INCLUDING A SHORT-CIRCUIT TERMINAL, AND UNIT CONTAINING THE SAME

(75) Inventors: Kazuto Ohtaka, Shizuoka (JP); Toshiharu Takahashi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/607,881

(22) Filed: Dec. 4, 2006

(65) Prior Publication Data

US 2007/0128932 A1 Jun. 7, 2007

(30) Foreign Application Priority Data

Dec. 7, 2005 (JP) ..... 2005-353488

(51) Int. Cl.
*H01R 29/00* (2006.01)

(52) U.S. Cl. ..... 439/188; 439/507

(58) Field of Classification Search ..... 439/188, 439/507

See application file for complete search history.

(56) References Cited

U.S. PATENT DOCUMENTS 5,277,608 A * 1/1994 Oda ..... 439/188
5,647,754 A * 7/1997 Kohno ..... 439/188
6,645,003 B2 * 11/2003 Yoshida et al. ..... 439/507

* cited by examiner

*Primary Examiner*—Tho D. Ta
(74) *Attorney, Agent, or Firm*—Kratz, Quintos & Hanson, LLP

(57) ABSTRACT

A connector unit includes a mating connector and a connector. The mating connector includes a canceling piece for canceling connections between the female terminals of a short-circuit terminal when the mating connector is connected to the connector. The connector includes a connector housing, female terminals, a short-circuit terminal, and a contact regulating part. The contact regulating part includes a regulating piece and a regulating projection. A through hole for passing a resilient contact piece of the short-circuit terminal is provided on the regulating piece. The regulating projection is projected from the other end of the resilient contact piece. The regulating projection prevents the other end from projecting toward the female terminal through the through hole.

7 Claims, 12 Drawing Sheets

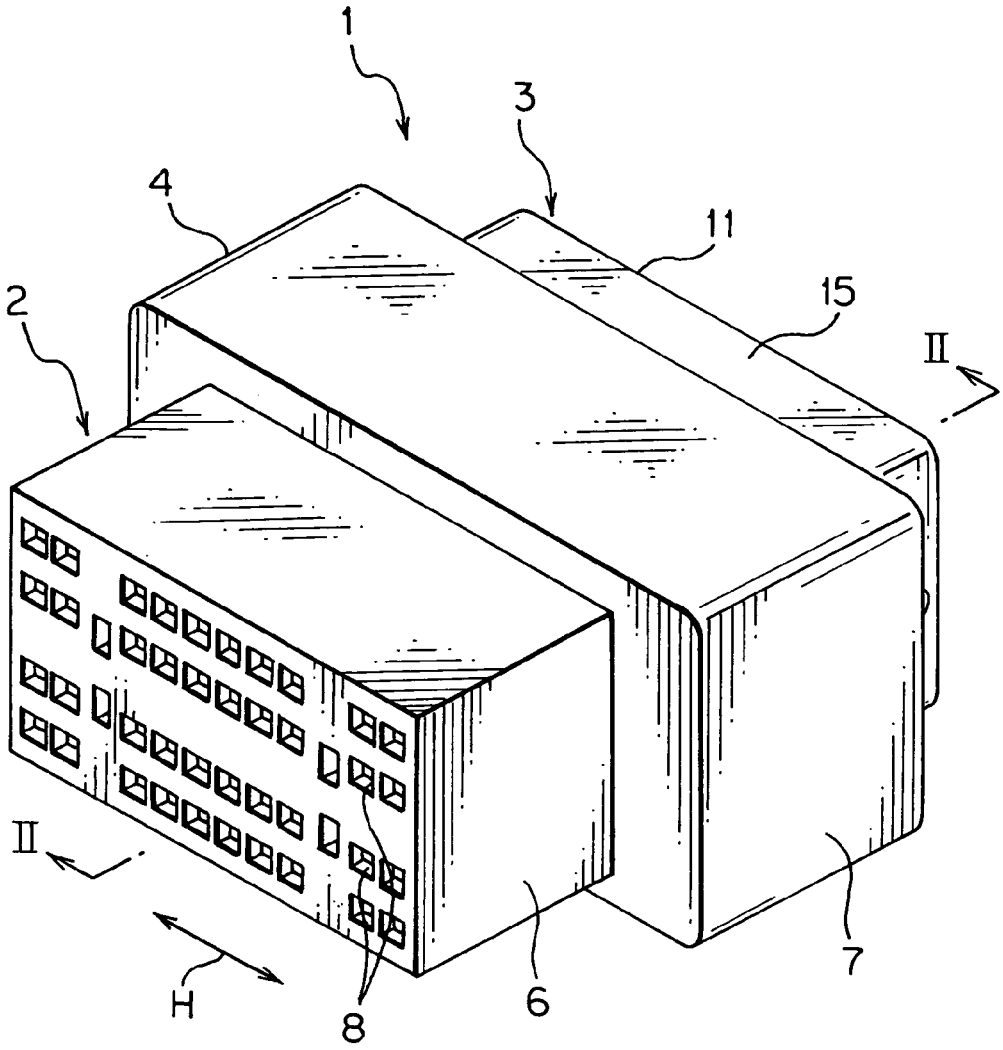
FIG. 1
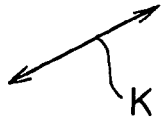

ELECTRICAL CONNECTOR INCLUDING A SHORT-CIRCUIT TERMINAL, AND UNIT CONTAINING THE SAME

CROSS REFERENCE TO RELATED APPLICATIONS

This application is based on Japanese Patent Application No. 2005-353488, the contents of which are hereby incorporated by reference.

BACKGROUND OF THE INVENTION

1. Field of the Invention

The present invention relates to a connector for connecting such as electric wires and a connector unit having the connector.

2. Description of the Related Art

Various electric components are mounted on a vehicle. A wiring harness is arranged on the vehicle for supplying electricity and signals from a controller to the electric components. The wiring harness includes electric wires and a connector. The wire includes an electrically conductive core wire and a coating made of insulating synthetic resin, which coats the core wire. The wire is a so-called coated wire.

A connector connected to an air bag includes an insulating connector housing, a terminal fitting received in the connector housing and connected to a gas generator of the air bag, a terminal fitting received in the connector housing and grounded, and a short-circuit terminal for connecting the terminal fittings.

The terminal fitting is connected to the gas generator and a ground through the wires. The short-circuit terminal release the connection between the terminal fittings when the connector is connected to the mating connector, and connects the terminal fittings when the connection between the connectors is canceled.

The short-circuit terminal includes a main body received in the connector housing, and a resilient contact piece of which one end is continued to the main body and extended to the mating connector, and of which the other end is a free end. The resilient contact piece is formed in a band shape, and resiliently contacts the terminal fitting. The resilient contact pieces are parallel to each other. Therefore, the main body, namely, the short-circuit terminal is positioned not between the two terminal fittings, but on a place overlapping with the two terminal fittings.

In the connector, for preventing a malfunction of the gas generator by static electricity when the mating connector is detached at a maintenance of the air bag, the short-circuit terminal connects the two terminal fittings. When the connector is connected to the mating connector, a projection or the like stands between the resilient contact piece and the terminal fitting to cancel the connection between the two terminal fittings.

As described the above, one end of the resilient contact piece of the short-circuit terminal used for the conventional connector is continued to the main body, and extended toward the mating connector. The other end of the resilient contact piece is a free end formed in a band shape. Therefore, there is a fear that when the resilient contact piece is engaged with the mating connector, a projection of the mating connector may bend the other end of the resilient contact piece. If the resilient contact piece is bent in a manner to project toward the terminal fitting, the shot-circuit terminal keeps the terminal fittings short-circuited even when the resilient contact piece is connected to the mating connector.

Accordingly, an object of the present invention is to provide a connector that allows to surely cancel a connection between the short-circuit terminal and the terminal fitting when the resilient contact piece is connected to the mating connector.

SUMMERY OF THE INVENTION

In order to attain the object, according to the present invention, there is provided a connector including:

at least two terminal fittings;

a connector housing having terminal-receiving chambers for receiving the terminal fittings; and a short-circuit terminal for electrically connecting the two terminal fittings to each other, wherein when the connector is connected to a mating connector, at least one of connections between the short-circuit terminal and the two terminal fittings is canceled, wherein the short-circuit terminal includes:

a fixed part to be fixed to the connector housing;

a resilient contact piece, one end of which is continued to the fixed part, and extended from the fixed part toward the mating connector, the other end of which is a free end and resiliently contacts one of the two terminal fittings; and a contact regulating part for preventing a deformation of the resilient contact piece so that the other end of the resilient contact piece is not projected toward the one of the terminal fittings.

Preferably, the contact regulating part is formed in between the short-circuit terminal and the one terminal fitting, and includes a regulating piece having a through hole for allowing the center of the resilient contact piece to touch the one of the terminal fittings, and a regulating part for preventing the other end of the resilient contact piece from passing through the through hole and projecting from the regulating piece toward the one of the terminal fittings.

Preferably, the regulating part is formed on the other end of the resilient contact piece, and includes regulating projections projected from the other end in a width direction of the resilient contact piece.

Preferably, the connector further includes a spacer attachable to and detachable from the connector housing, said spacer preventing the terminal fittings from falling out of the terminal-receiving chambers, and including the regulating piece.

Preferably, the short-circuit terminal further includes a contact piece for contacting the other terminal fitting.

Preferably, the short-circuit terminal is interposed between the two terminal fittings.

According to another aspect of the invention, there is provided a connector unit including: a connector as claimed in any one of precedent claims; and a mating connector connected to the connector, and including a canceling part for canceling at least one of connections between the short-circuit terminal and the two terminal fittings when the mating connector is connected to the connector.

These and other objects, features, and advantages of the present invention will become more apparent upon reading of the following detailed description along with the accompanied drawings.

BRIEF DESCRIPTION OF THE DRAWINGS

FIG. 1 is a perspective view showing a connector unit having connectors according to an embodiment of the present invention;

DETAILED DESCRIPTION OF THE PREFERRED EMBODIMENTS

Figure 2:
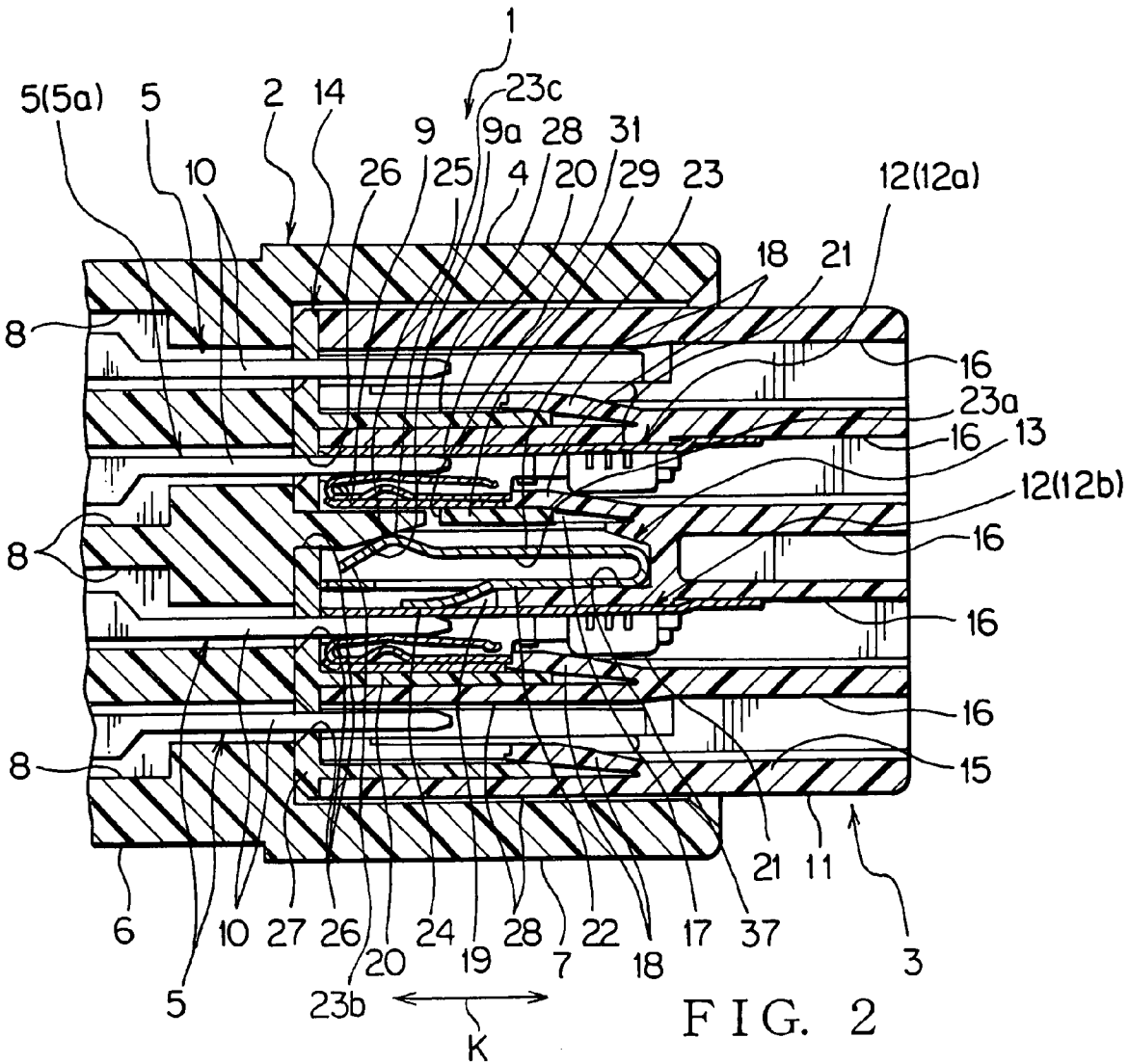
FIG. 2 is a sectional view taken on line II-II of FIG. 1.

An embodiment of a connector unit 1 according to the present invention will be described with reference to FIGS. 1 to 14. The connector unit 1 composes a wiring harness, and as shown in FIGS. 1 to 4, includes a mating connector 2 and a connector 3.

As shown in FIGS. 1 to 4, the mating connector 2 includes a mating connector housing 4, and a male terminal 5 as a mating terminal fitting. The mating connector housing 4 is made of insulating synthetic resin, and includes a box-shaped main body 6, and a tubular skirt 7.

Figure 3:
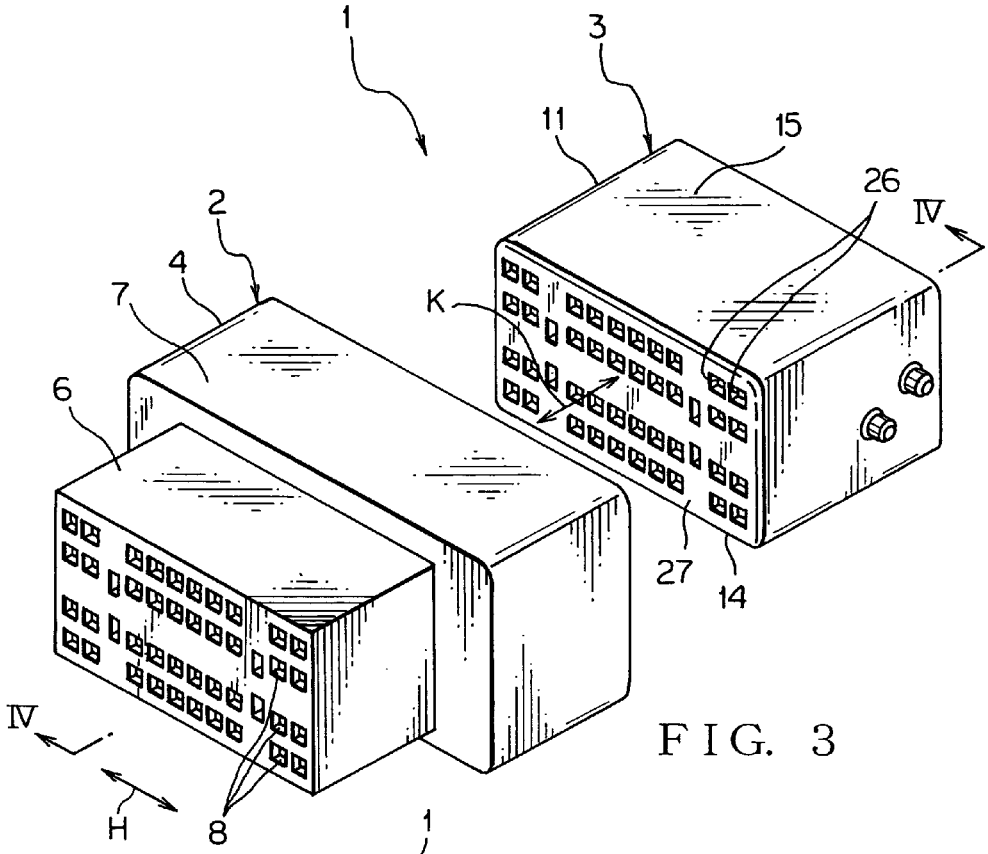
FIG. 3 is a perspective view showing the connectors separated from each other of the connector unit in FIG. 1.
Figure 4:
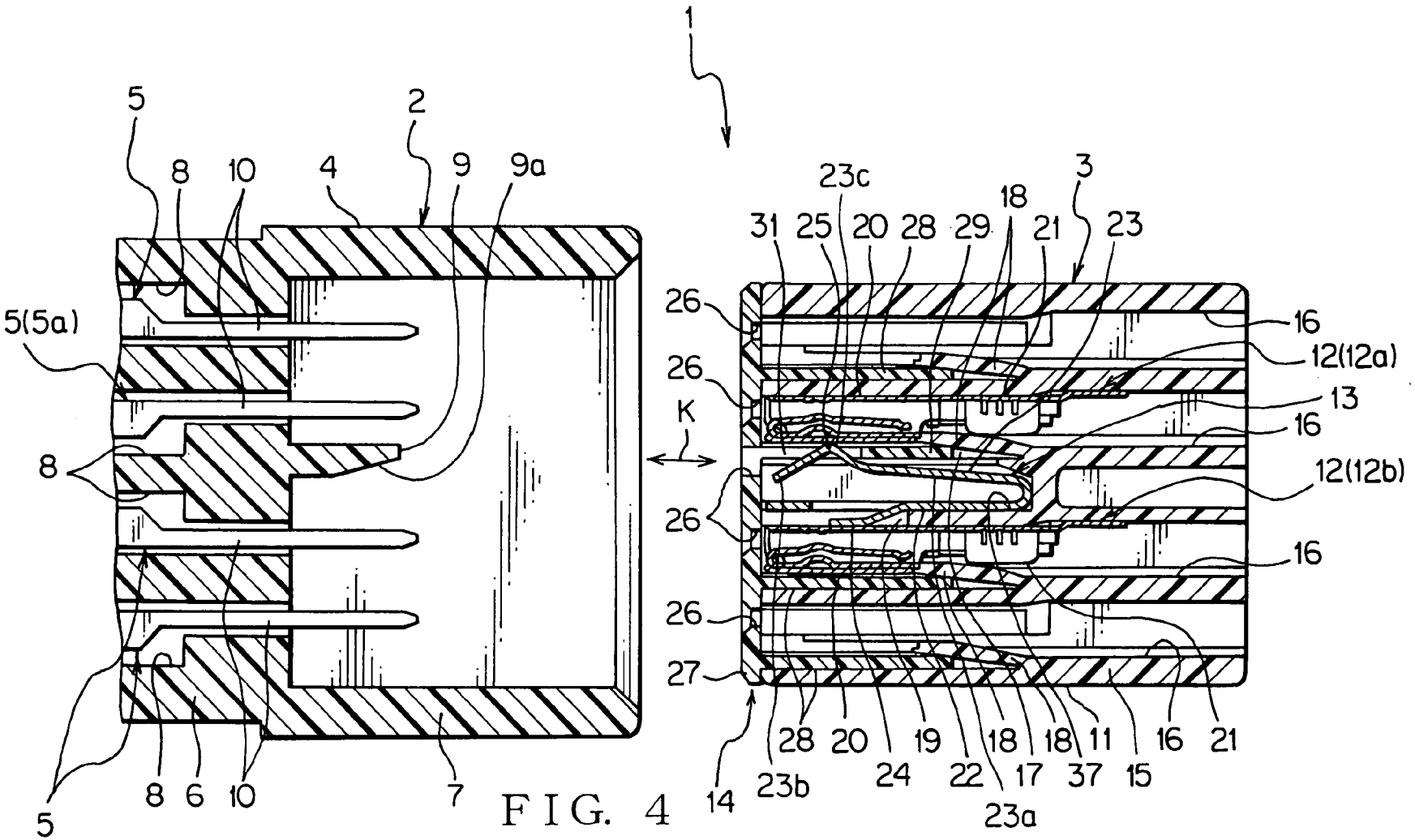
FIG. 4 is a sectional view taken on line IV-IV in FIG. 3.

As shown in FIGS. 2 to 4, the main body 6 includes a plurality of terminal-receiving chambers 8, a releasing piece 9, and a not-shown locking part. The terminal-receiving chamber 8 is a straight space formed in the main body 6, and receives the male terminal 5. The terminal-receiving chambers 8 are disposed parallel to each other.

The releasing piece 9 is formed integrally with the main body 6. The releasing piece 9 is made of insulating synthetic resin. The releasing piece 9 is projected from a surface facing the connector 3 toward the connector 3. When the connectors 2, and 3 are connected to each other, the releasing piece 9 is inserted into a later-described bending space 17 of the connector 3. A taper wall 9*a* is formed on the releasing piece 9 for abutting on a resilient contact piece 23 of a later-described shot-circuit terminal 13 when the releasing piece 9 is inserted into the bending space 17. The taper wall 9 is tapered in a direction K (shown in FIG. 4).

When the releasing piece 9 is inserted into the bending space 17 and the taper wall 9*a* abuts on the resilient contact piece 23 of the short-circuit terminal 13, because the taper wall 9*a* is tapered, the resilient contact piece is gradually removed from a later-described female terminal 12. Thus, the releasing piece 9 gradually separates the resilient contact piece 23 from the female terminal 12 when the connectors 2 and 3 are connected to each other.

Because the releasing piece 9 is made of insulating resin, when the connectors 2, 3 are connected to each other, the releasing piece 9 separates the resilient contact piece 23 from the female terminal 12 to cancel an electrical connection between the short-circuit terminal 13 and the female terminal fitting 12.

The locking part is locked with a mating locking part formed on a later-described connector housing 11 of the connector 3 to connect the connector housings 4, 11, namely, the connectors 2, 3 to each other.

Male terminals 5 are formed of a conductive metal. The male terminals 5 are formed by stamping or folding a metal plate. Each male terminal 5 integrally includes a bar-shaped electric contact part 10 and a not-shown wire contact part continued to the electric contact part 10. The electric contact part 10 is projected from the surface toward the skirt 7 when the male terminal 5 is received in the terminal-receiving chamber 8.

When the connectors 2, 3 are connected to each other, the electric contact part 10 is inserted into a later-described terminal-receiving chamber 16, and electrically and mechanically connected to an electric contact part 20 of the female terminal fitting 12. A wire connecting part 21 is received in the terminal-receiving chamber 8. The wire connecting part 21 is electrically connected to a core wire of a not-shown wire. The male terminal 5 electrically connects the electric wire to the female terminal fitting 12.

One male terminal 5*a* of male terminals 5 is connected to a collision detection sensor of an air bag as sensitive equipment, or a battery. The male terminal 5*a* supplies a signal indicating a collision of a vehicle detected by the collision detection sensor, or a power from the battery through the female terminal fitting 12 to a gas generator of the air bag.

The sensitive equipment requires canceling static electricity caused by disconnecting the connectors 2, 3 for preventing malfunction.

The connector 3, as shown in FIGS. 1 to 4, includes a connector housing 11, a female terminal 12, a short-circuit terminal 13, a front holder as a spacer, and a contact regulating part 38.

The connector housing 11 is made of insulating synthetic resin. The connector housing 11 includes a box-shaped main body 15. The main body 15 includes a terminal-receiving chamber 16 for receiving the female terminal 12, a receiving part 37, the bending space 17, and the not-shown mating locking part with which the locking part is locked.

A plurality of terminal-receiving chambers 16 is provided in the main body 15. Each terminal-receiving chamber 16 is a straight space. Both ends of the terminal-receiving chamber 16 are opened on an outer wall of the main body 15. The terminal-receiving chambers are disposed parallel to each other.

A locking piece 18 is formed at each terminal-receiving chamber 16. One end of the locking piece 18 is continued to an inner wall of the terminal-receiving chamber 16, and the other end of the locking piece 18 is positioned inside of the terminal-receiving chamber 16 when the locking piece 18 is not resiliently deformed. The other end of the locking piece 18 can be locked with an end of the electric contact part 20 of the female terminal 12 near the wire connecting part 21. The other end of the locking piece 18 can be resiliently deformed in a longitudinal direction of the terminal-receiving chamber 16.

When the female terminal 12 is inserted into the terminal-receiving chamber 16, the electric contact part 20 of the female terminal 12 pushes the locking piece 18 so that the other end of the locking piece 18 is resiliently deformed in the bending space 17 toward an outside of the terminal-receiving chamber 16. Then, when the electric contact part 20 of the female terminal 12 runs over the other end of the locking piece 18, the other end is again disposed in the terminal-receiving chamber 16 by a resilient force, and locked with the end of the electric contact part 20 of the female terminal 12. Thus, the locking piece 18 prevents the female terminal 12 from falling out of the terminal-receiving chamber 16.

The receiving part 37 is a straight space mounted on the main body 15. The receiving part 37 is disposed between the two terminal-receiving chambers 16 next to each other, and opened at a surface of the main body 15 facing the mating connector 2. The receiving part 37 is next to the locking piece 18 of one of the two terminal-receiving chambers 16 next to each other.

The bending space 17 is mounted on each terminal-receiving chamber 16. The bending space 17 is a part of a space in the terminal-receiving chamber 16, and positions the locking piece 18. In the bending space 17, when the female terminal 12 is inserted, the locking piece 18 is once resiliently deformed.

Further, one of the two terminal-receiving chamber 16 positioning the receiving part 37 and the receiving part 37 communicate each other through the bending space 17. The bending space 17 allows a later-described resilient contact piece 23 of the short-circuit terminal 13 to pass inside the bending space 17. A communicating hole 19 is formed for communicating the other one of the two terminal-receiving chambers 16 and the receiving part 37. The communicating hole 19 allows the later-described contact piece of the short-circuit terminal 13 to pass inside the communicating hole 19.

When the locking part is locked with the mating locking part, the main body 15 is inserted into the skirt 7 of the mating connector 4.

The female terminal 12 is made by stamping or folding a metal plate. The female terminal 12 is extended straight and integrally includes the pipe-shaped electric contact part 20 and the wire connecting part 21 continued to the electric contact part 20. When the electric contact part 10 of the male terminal 5 is inserted into the electric contact part 20, the electric contact part 20 is electrically and mechanically connected to the electric contact part 10. A not-shown electric wire is attached to the wire connecting part 21, and a core wire of the wire is electrically connected to the wire connecting part 21. When the connector 2, 3 are connected to each other, the electric contact part 10 of the male terminal 5 is inserted into the electric contact part 20 of the female terminal 12, and connects the wire to the male terminal 5.

The one female terminal 12*a* of the two female terminals 12 electrically connected to the male terminal 5*a* is connected to the gas generator of the air bag as sensitive equipment. The other female terminal 12*b* is connected to the earth. The one female terminal 12*a* is one terminal fitting in the present invention, and the other female terminal 12*b* is the other terminal fitting in the present invention.

Figure 5:
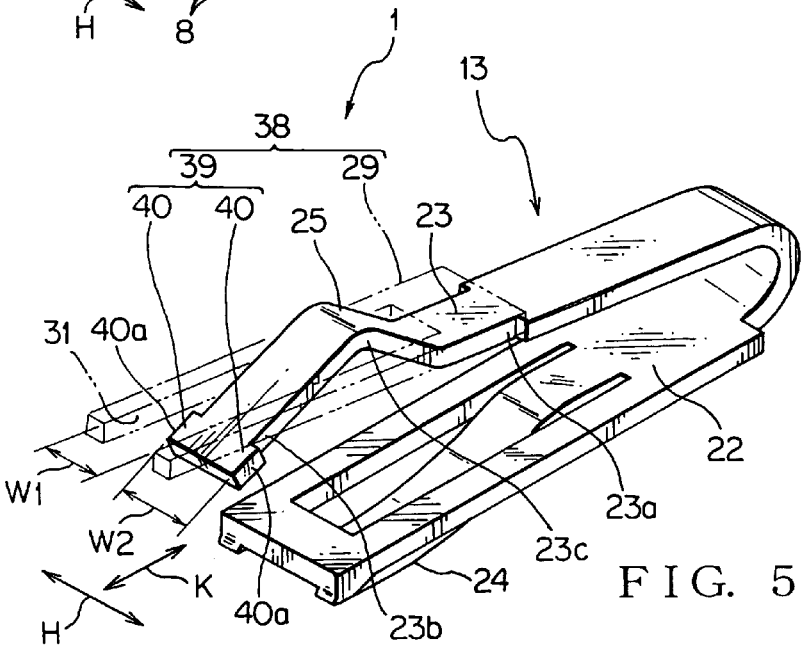
FIG. 5 is a perspective view showing a short-circuit terminal of the connector in FIG. 1.

The short-circuit terminal 13 is made by stamping or folding a metal plate. As shown in FIG. 5, the short-circuit terminal 13 integrally includes a fixed part 22, the resilient contact piece 23, and a contact piece 24.

The fixed part 22 is formed in a rectangular band shape. The fixed part 22 is received in the receiving part 37 and fixed to the inner wall of the receiving part 37. Thus, the fixed part 22 is interposed between the two female terminals 12*a*, 12*b*.

One end 23*a* of the resilient contact piece 23 is continued to an end of the fixed part 22 away from the mating connector 2, and extended from the fixed part 22 toward the mating connector 2. The other end 23*b* of the resilient contact piece 23 is formed as a band-shaped free end. A point of contact 25 for contacting the one female terminal 12*a* is provided at a center part 23*c* interposed between the ends 23*a*, 23*b* of the resilient contact piece 23. The point of contact 25 is a part curved at the center part 23*c* of the resilient contact piece 23 toward the one female terminal 12*a*, namely, an outside of the short-circuit terminal 13.

The resilient contact piece 23 is resiliently deformable in a manner that the point of contact 25 is movable away from and close to the one female terminal 12*a*. When the point of contact 25 is abut on the one female terminal 12*a*, the resilient contact piece 23 is resiliently deformed in a manner that the point of contact 25 is moved away from the one female terminal 12*a*. When the short-circuit terminal 13 is received in the receiving part 37, the resilient contact piece 23 abuts resiliently on the one female terminal 12*a* through the bending space 17.

The contact piece 24 is formed in a manner that a part of the fixed part 22 is cut and raised toward the outside of the short-circuit terminal 13. The contact piece 24 is gradually inclined in the direction K toward the outside of the short-circuit terminal 13 from the fixed part 22 as approaching the mating connector 2. When the short-circuit terminal 13 is received in the receiving part 37, the contact piece 24 abuts on the other female terminal 12*b* through the communicating hole 19. Thus, the contact piece 24 resiliently contacts the other female terminal 12*b*.

The resilient contact piece 23 and the contact piece 24 are disposed back to back through the fixed part 22. Longitudinal sides of the resilient contact piece 23 and the contact piece 24 are disposed parallel to each other.

The short-circuit terminal 13 is inserted into the receiving part 37 through an opening on a wall facing the mating connector 2. At this time, the other end 23*b* of the resilient contact piece 23 is positioned nearer the mating connector 2 than the one end 23*a*. When the male terminals 12*a*, 12*b* are respectively inserted into the two terminal-receiving chambers 16, the resilient contact piece 23 resiliently contacts the one female terminal 12*a* and the contact piece 24 contacts the other female terminal 12*b*. Thus, the short-circuit terminal 13 electrically connects the two female terminals 12*a*, 12*b* to each other by the resilient contact piece 23 and the contact piece 24 contacting the two female terminals 12*a*, 12*b*.

Figure 6:
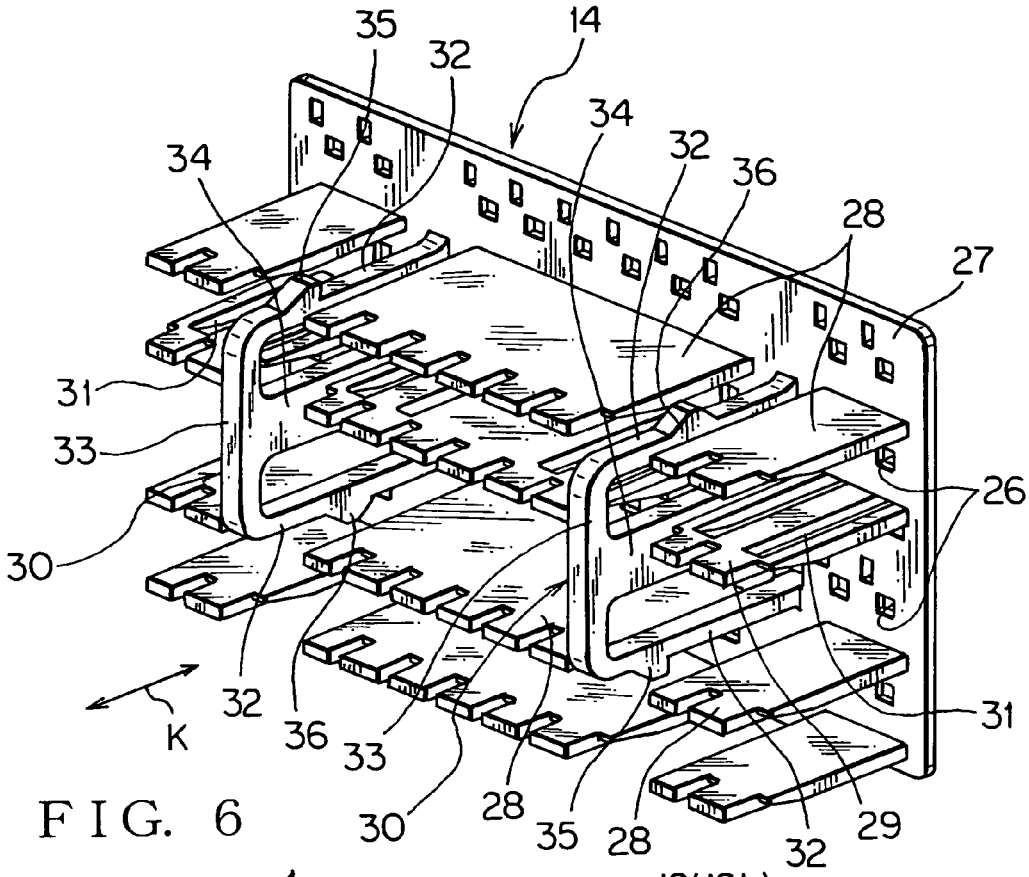
FIG. 6 is a perspective view showing a front holder of the connector in FIG. 1.

As shown in FIG. 6, the front holder 14 includes a flat plate 27 having a plurality of holes 26, a deformation regulating piece 28, and a locking part 30. The flat plate 27 is overlapped with a surface of the main body 15 of the connector housing 11 facing the mating connector 2. The holes 26 mounted on the flat plate 27 respectively communicate with the terminal-receiving chambers 16 and the receiving part 37. The holes 26 are arranged in the direction K with the terminal-receiving chamber 16 and the receiving part 37.

The deformation-regulating piece 28 is formed in a band shape, and extended vertically from the flat plate 27. When the flat plate 27 is overlapped with the surface of the main body 15, the deformation-regulating piece 28 is inserted into the terminal-receiving chamber 16. After the end of the deformation regulating piece 28 is positioned between the inner wall of the terminal-receiving chamber 16 and the locking piece 18, the deformation regulating piece 28 prevents the locking piece 18 from being resiliently deformed, namely the deformation regulating piece 28 prevents the female terminal 12 from falling out of the terminal-receiving chamber 16.

Thus, when the front holder 14 is attached to the main body 15 at a later-described regular locking position, the deformation-regulating piece 28 prevents the locking piece 18 from being deformed together with the later-described regulating piece 29.

According to FIG. 6, two locking parts 30 are provided. Each locking part 30 includes a pair of standing bars 32 standing in the same direction as the deformation regulating piece 28 and the regulating piece 29 from the flat plate 27, a connecting bar 33, a supporting bar 34, a temporary locking projection 35, and a regular locking projection 36. Each of the pair of standing bars 32 is formed in a bar shape, and is disposed parallel to each other.

The connecting bar 33 is formed in a straight bar shape and connects ends of the pair of standing bars 32 away from the flat plate 27. The supporting bar 34 stands in the same direction as the deformation-regulating piece 28 from the flat plate 27, and is continued to the connecting bar 33. The temporary locking projection 35 is projected from one of the standing bars 32 and is locked with a mating locking part formed on the main body 15 of the connector housing 11. The regular locking piece 36 is projected from the other one of the standing bars 32, and is locked with the mating locking part mounted on the main body 15 of the connector housing 11. The regular projection 36 is disposed nearer the flat plate 27 than the temporary projection 35.

The front holder 14 is attached to the main body 15 at both the temporary locking position where the temporary locking projection 35 is locked with the mating locking part and the regular position where the regular locking position 36 is locked with the mating locking part. At this time, the flat plate 27 is disposed parallel to the surface of the main body 15 of the connector housing 11.

Figure 7:
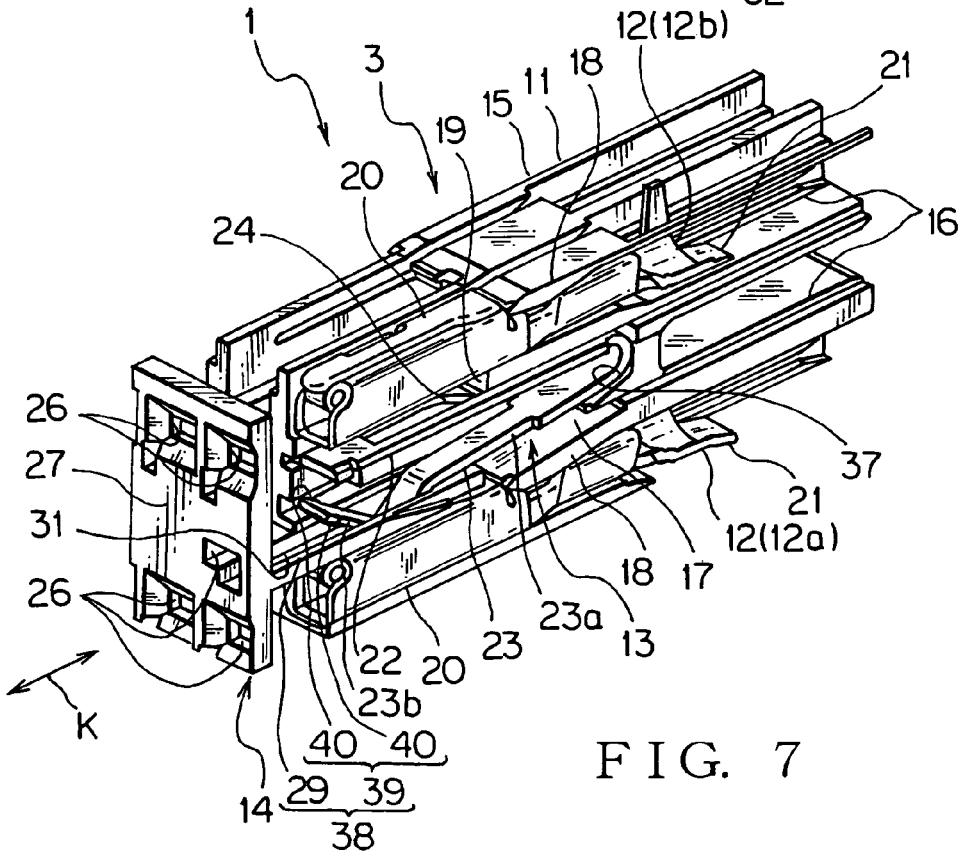
FIG. 7 is a perspective view showing the front holder in FIG. 6 positioned at a temporarily locking position.
Figure 8:
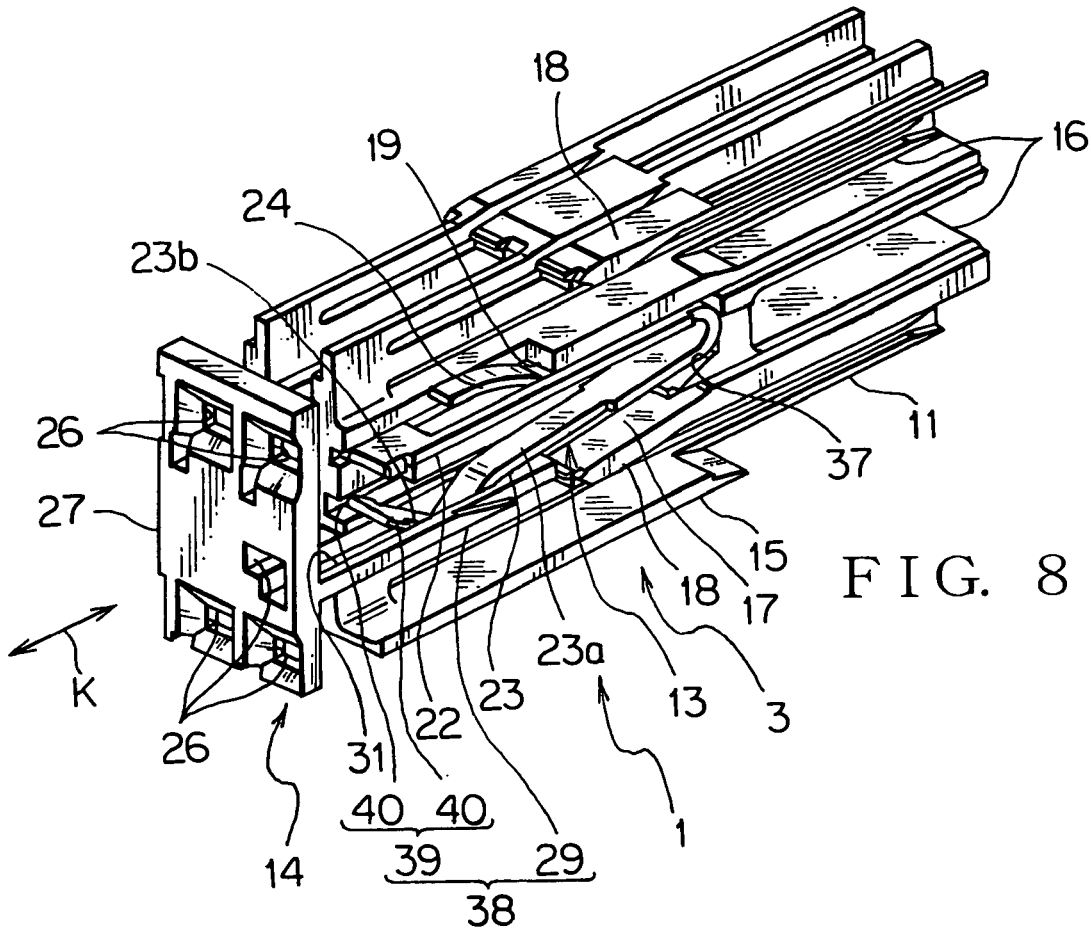
FIG. 8 is another perspective view showing the front holder in FIG. 6 positioned at a temporary locking position.

As shown in FIGS. 7 and 8, in the temporary position of the front holder 14, the flat plate 27 is separated from the surface of the flat plate 27. Further, an end of the deformation regulating piece 28 is not positioned between the inner wall of the terminal-receiving chamber 16 and the locking piece 18. Further, a tip end of the regulating piece 29 is not overlapped with the locking piece 18. Namely, at the temporary position of the front holder 14, the locking piece 18 can be resiliently deformed, and the female terminals 12, 12*a*, 12*b* can be inserted into the terminal-receiving chamber 16.

As shown in FIGS. 2 and 4, at the regular position of the front holder 14, the flat plate 27 is overlapped with the surface of the main body 15. Further, the top end of the deformation regulating piece 28 is positioned between the inner wall of the terminal-receiving chamber 16 and the locking piece 18. Further, the top end of the regulating piece 29 is overlapped with the locking piece 18. Namely, at the regular position of the front holder 14, the regulating pieces 28, 29 prevent the locking piece 18 from being resiliently deformed, and prevent the female terminals 12, 12*a*, 12*b* from being inserted. Thus, in the connector 3, both the locking piece 18 and the front holder 14 double-lock the female terminals 12, 12*a*, 12*b*.

A contact regulating part 38 includes the regulating piece 29 and a regulating part 39. The regulating piece 29 is formed in a band shape, and extended from the flat plate 27 of the front holder 14. When the flat plate 27 is overlapped with the surface of the main body 15, the regulating piece 29 is inserted into the bending space 17.

When the top end of the regulating piece 29 is overlapped with the locking piece 18 of the one of the terminal-receiving chambers 16 receiving the one female terminal 12*a* in a direction perpendicular to the direction K, the regulating piece 29 prevents the locking piece 18 from being resiliently deformed, namely, prevents the female terminal 12*a* from falling out of the terminal-receiving chamber 16.

As shown in two dotted line in FIG. 5, a through hole 31 is formed on the regulating piece 29. The resilient contact piece 23 of the short-circuit terminal 13 received in the receiving part 37 is passed through the through hole 31. The point of contact 25 of the resilient contact piece 23 can abut on the one female terminal 12*a* through the through hole 31.

As shown in FIG. 5, the regulating part 39 includes a pair of regulating projections 40. The regulating projections 40 are formed integrally with the resilient contact piece 23 of the short-circuit terminal 13 and projected in a width direction H of the other end 23*b*.

As shown in FIG. 5, a width W2 between top end walls 40*a* of the regulating projections 40 is wider than a width W1 of the through hole 31. Therefore, the contact regulating part 38 prevents the other end 23*b* from projecting toward the female terminal 12*a* through the through hole 31. When connectors are connected to each other, the contact regulating part 38 prevents the other end 23*b* from projecting toward the one female terminal 12*a*, prevents the resilient contact piece 23 from curling up and prevents the resilient contact piece 23 from abutting on the one female terminal 12*a*.

Figure 9A:
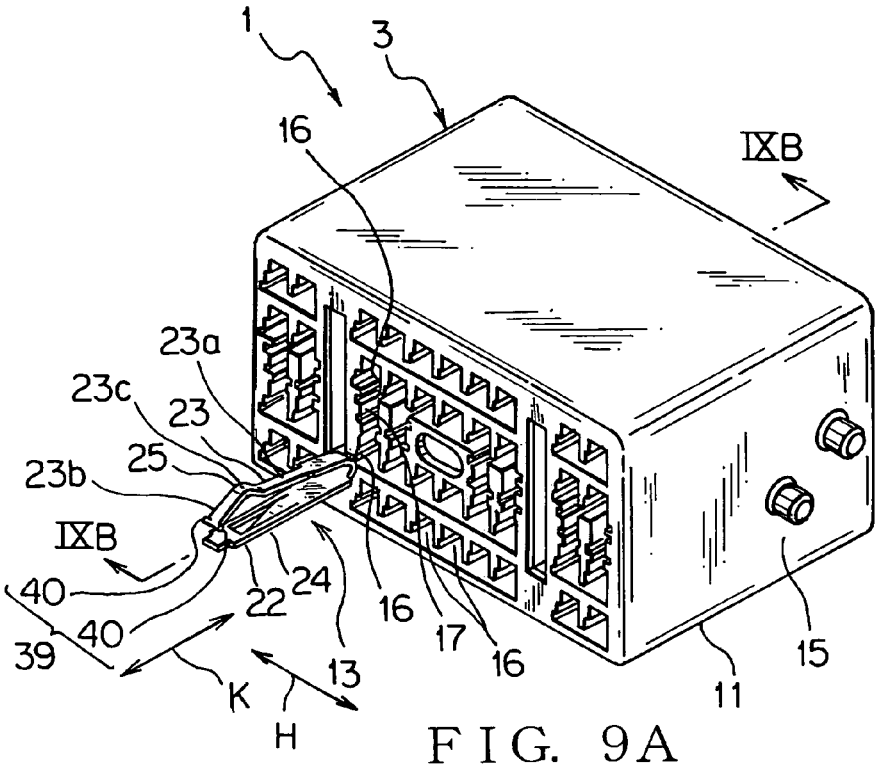
FIG. 9A is a perspective view showing a connector housing and the short-circuit terminal shown in FIG. 1.
Figure 9B:
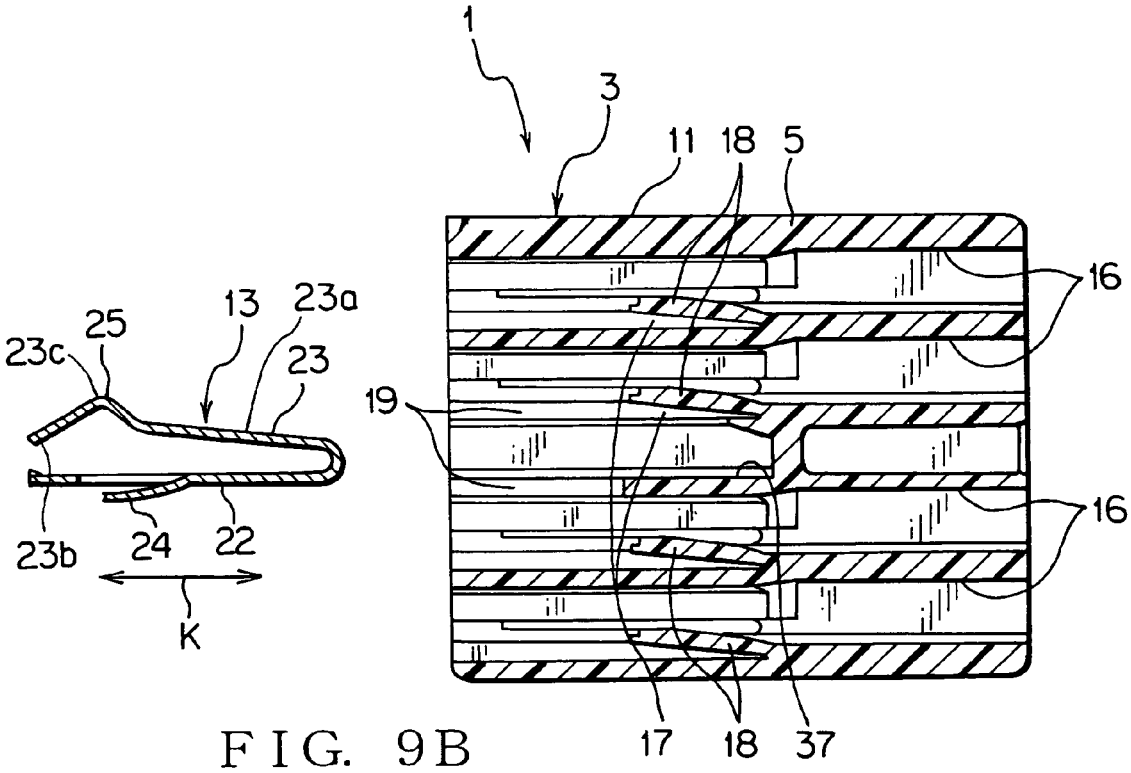
FIG. 9B is a sectional view taken on line IXB-IXB in FIG. 9A.
Figure 10A:
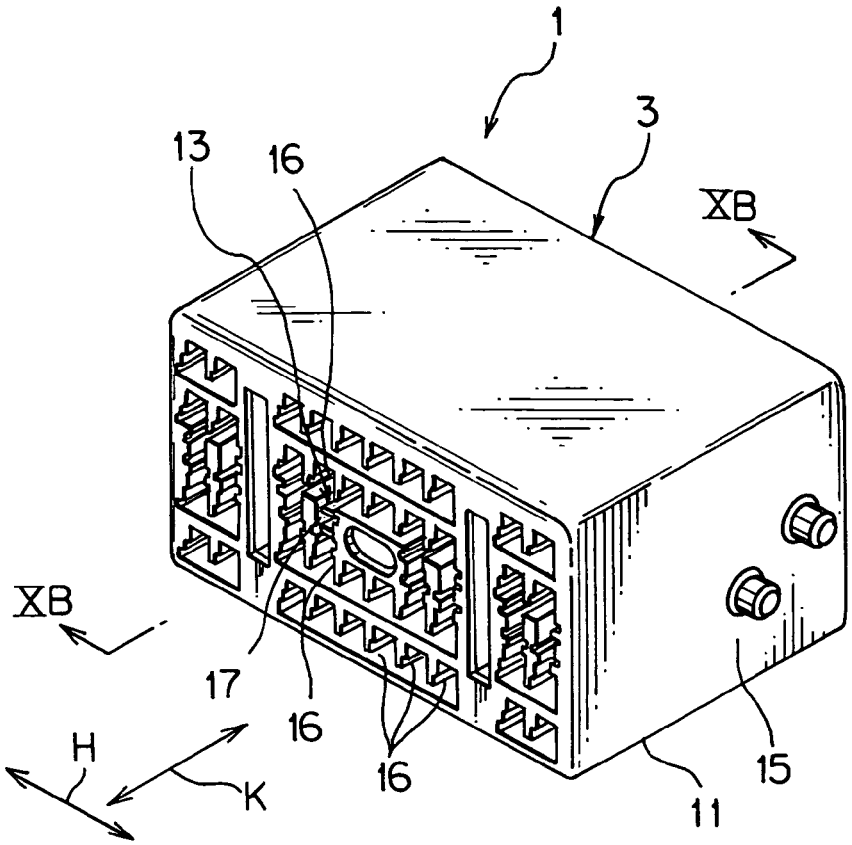
FIG. 10A is a perspective view showing the short-circuit terminal in FIG. 9 received in the connector housing.
Figure 10B:
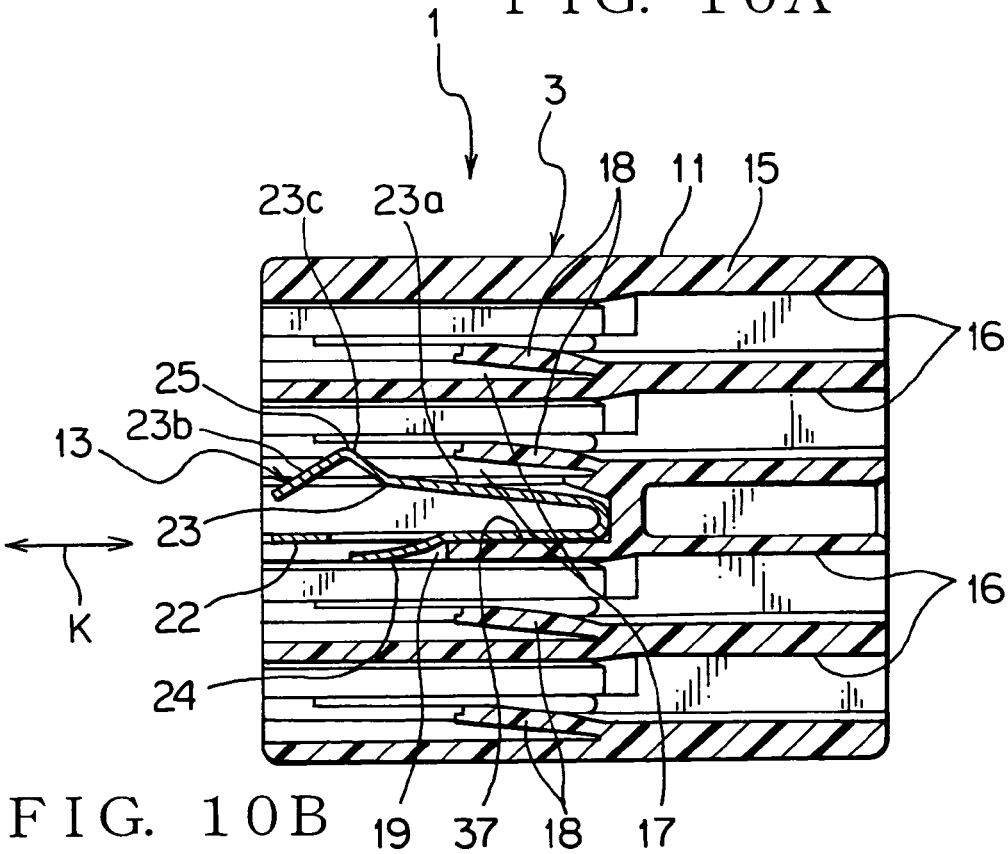
FIG. 10B is a sectional view taken on line XB-XB in FIG. 10A.

The connector 3 is assembled as described below. First, as shown in FIGS. 9A and 9B, the short-circuit terminal 13 faces an opening of the receiving part 37. Then, the short-circuit terminal 13 is inserted into the receiving part 37. Then, as shown in FIGS. 10A and 10B, the receiving part 37 receives the short-circuit terminal 13. At this time, the other end 23*b* of the resilient contact piece 23 is disposed near the surface of the main body 15.

Figure 11A:
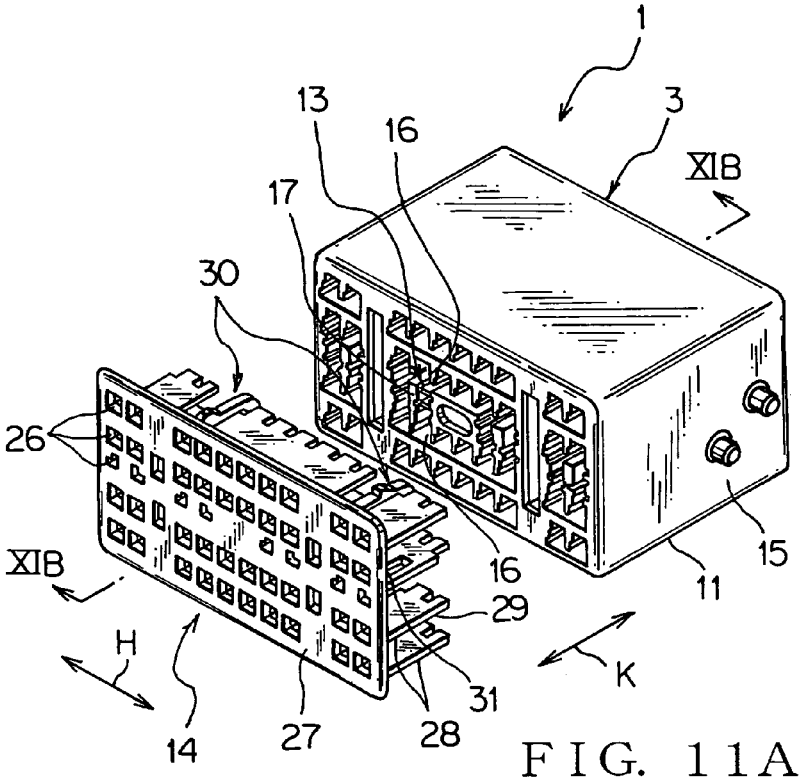
FIG. 11A is a perspective view showing the connector housing and the front holder shown in FIG. 10.
Figure 11B:
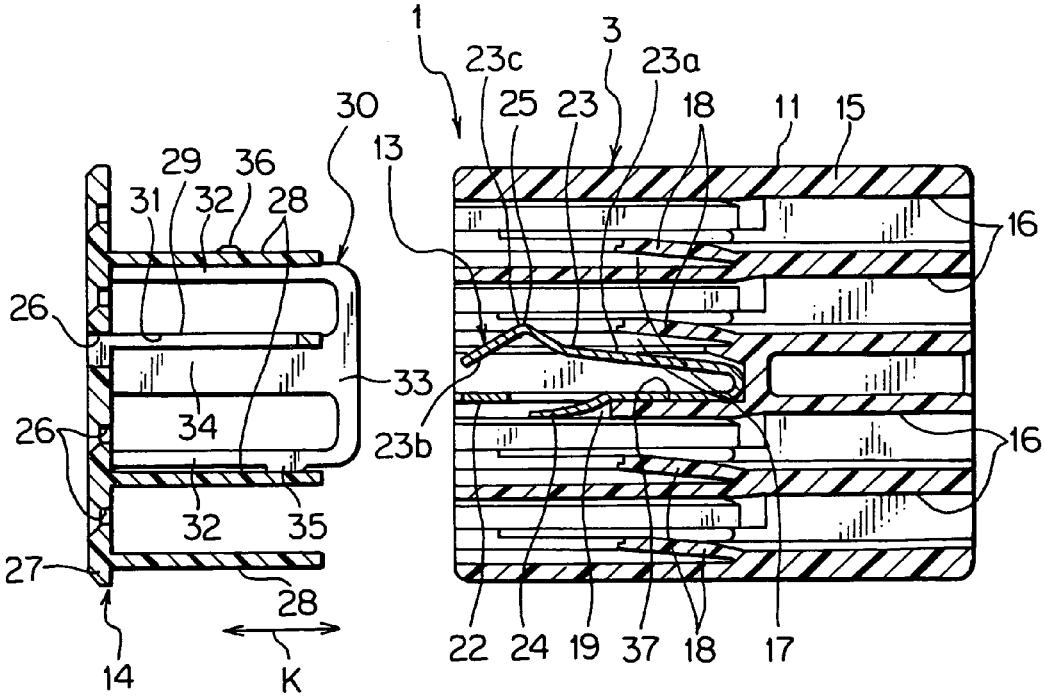
FIG. 11B is a sectional view taken on line XIB-XIB in FIG. 11A.
Figure 12A:
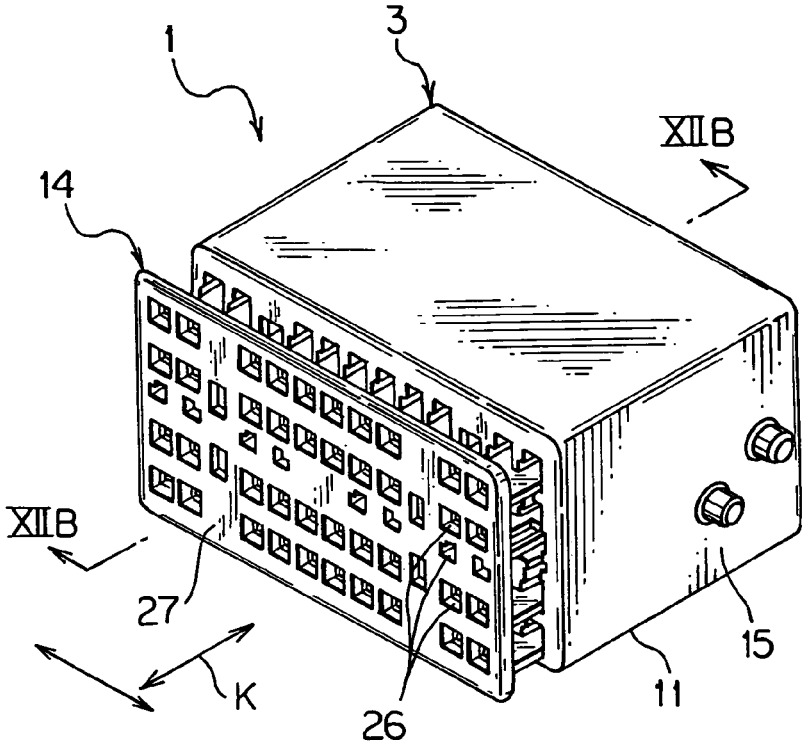
FIG. 12A is a perspective view showing the front holder in FIG. 11 positioned at the temporary locking position.
Figure 12B:
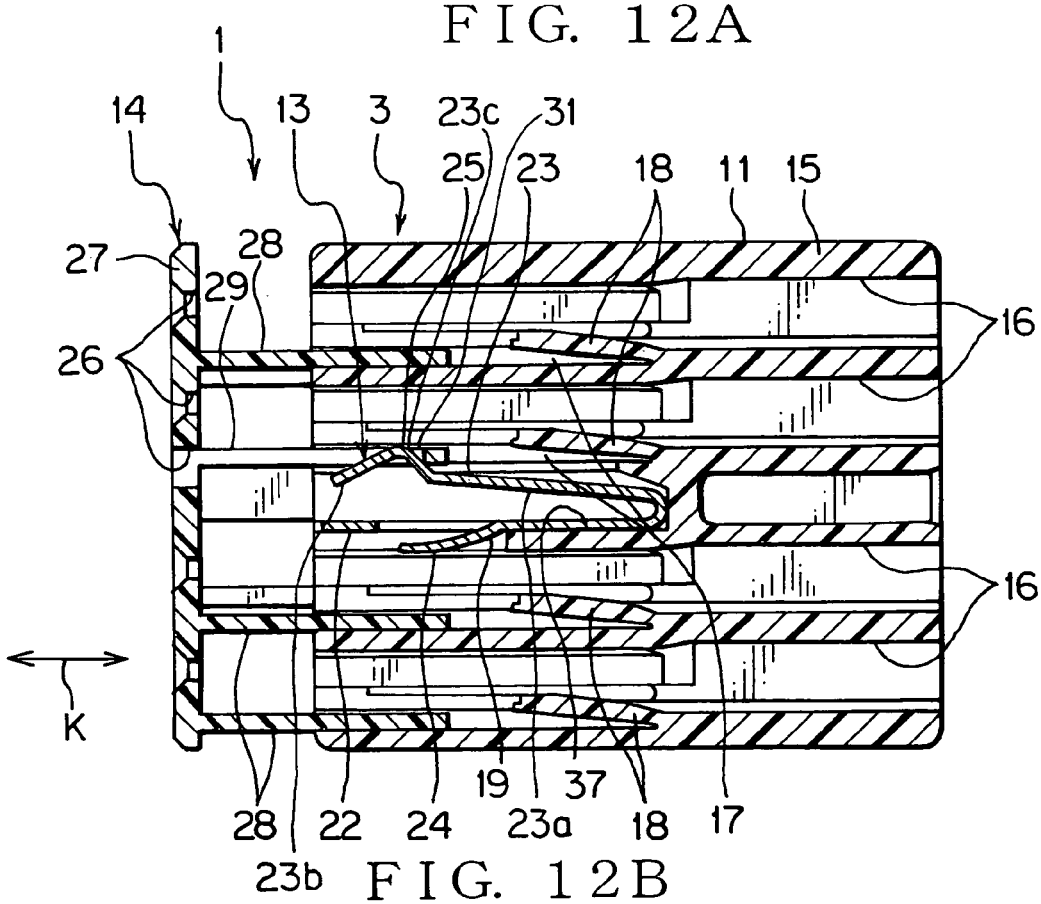
FIG. 12B is a sectional view taken on line XIIB-XIIB in FIG. 12A.
Figure 13A:
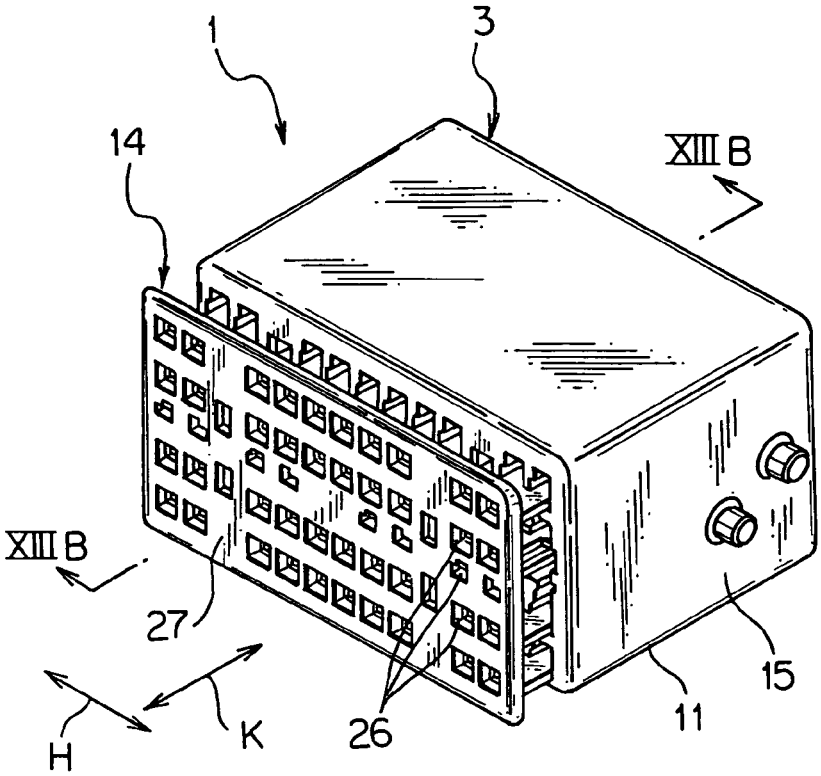
FIG. 13A is a perspective view showing male terminals received in the connector housing in FIG. 12.
Figure 13B:
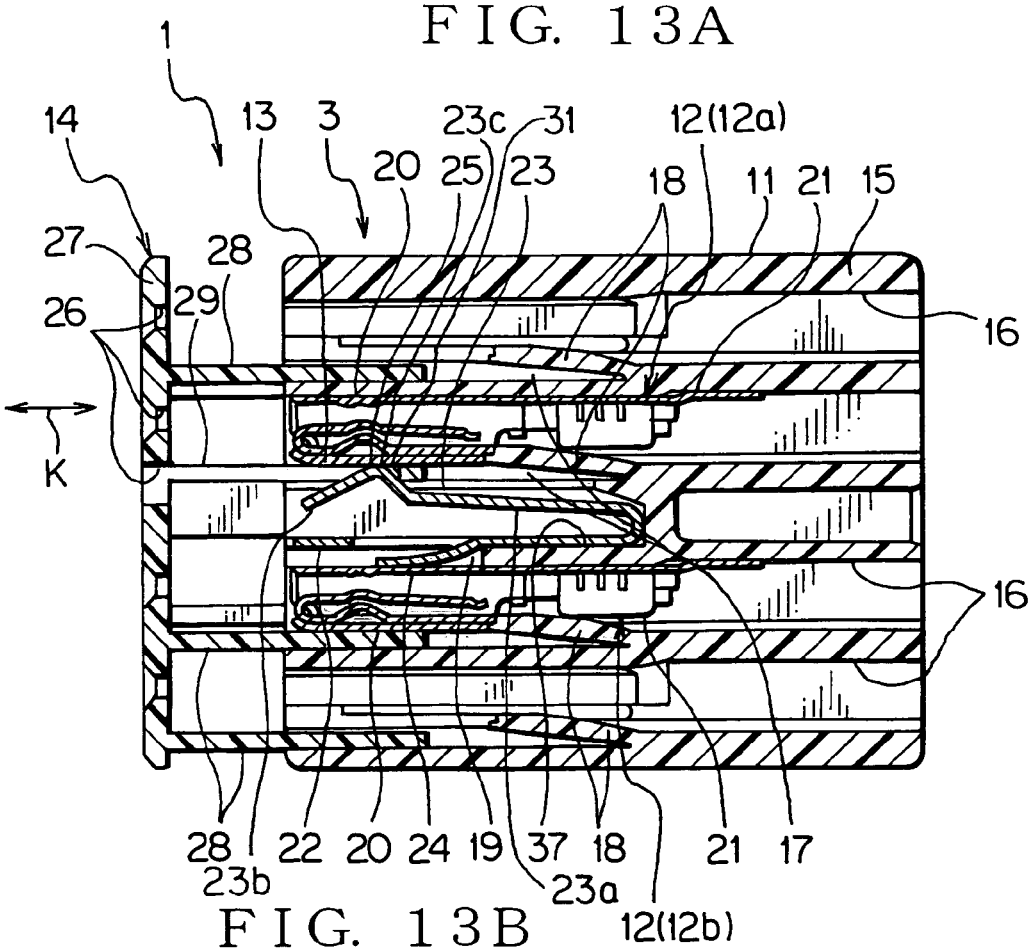
FIG. 13B is a sectional view taken on line XIIIB-XIIIB in FIG. 13A.

Then, as shown in FIGS. 11A and 11B, the front holder 14 is disposed in a manner that the deformation regulating piece 28 and the regulating piece 29 face the terminal-receiving chamber 16 and the opening of the receiving part 37. Then, the deformation-regulating piece 28 and the regulating piece 29 are inserted into the terminal-receiving chamber 16 and the receiving part 37 to lock the temporary locking projection 35 with the mating locking part. Thus, as shown in FIGS. 13A and 13B, the front holder 14 is positioned at the temporary locking position.

Then, the female terminals 12, 12*a*, 12*b* having wires are inserted into the terminal-receiving chambers 16 of the main body 15. Then, the locking pieces 18 are once resiliently deformed in the bending space 17 and then locked at ends of the electric contact part 20 of the female terminals 12, 12*a*, 12*b*. Then, as shown in FIGS. 13A, 13B, the female terminals 12, 12*a*, 12*b* are received in the terminal-receiving chambers 16.

Figure 14A:
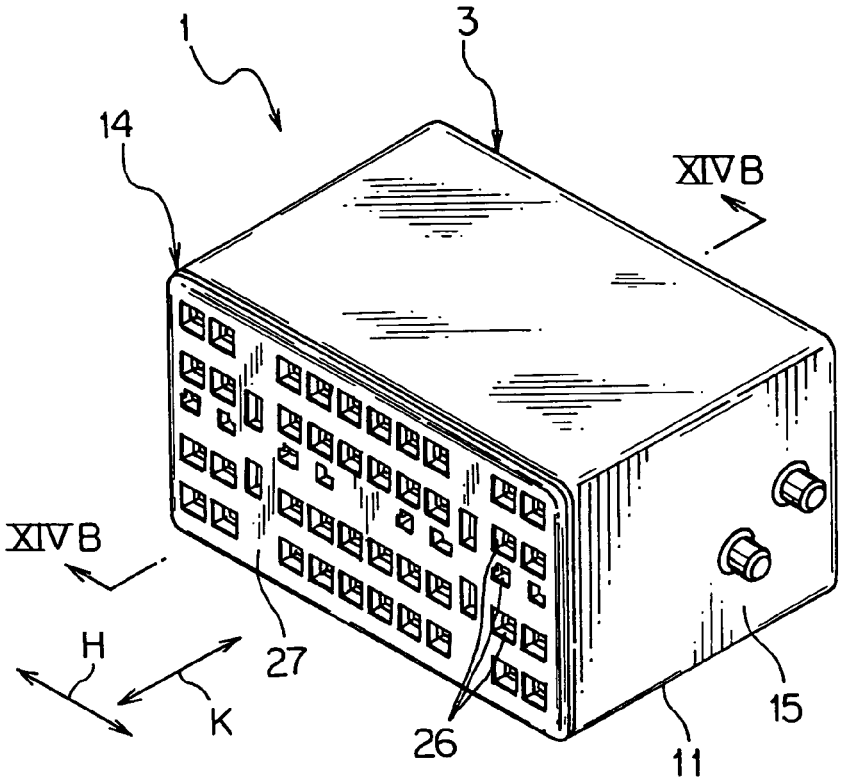
FIG. 14A is a perspective view showing the front holder positioned at the temporary locking position.
Figure 14B:
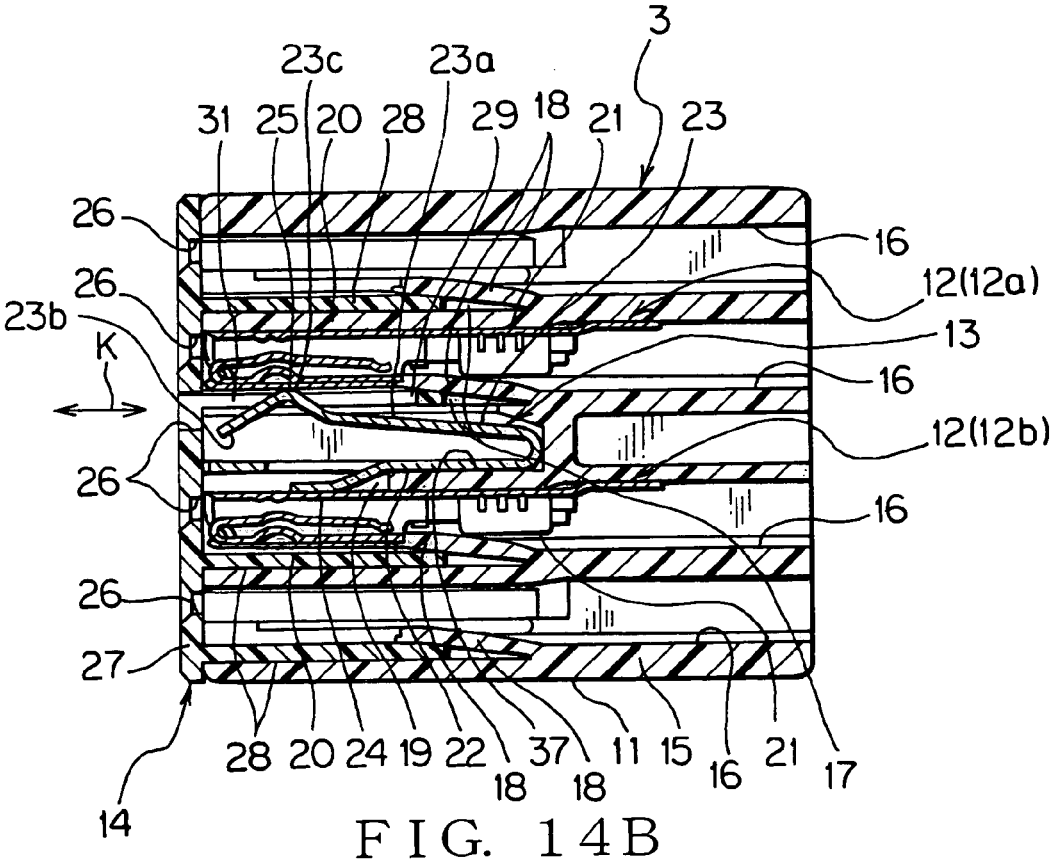
FIG. 14B is a sectional view taken on line XIVB-XIVB in FIG. 14A.

Then, the flat plate 27 of the front holder 14 is pushed to the surface of the main body 15 to lock the regular locking projection 36 with the mating locking part. Thus, the front holder 14 is positioned at the regular locking position. Then, as shown in FIGS. 14A and 14B, the point of contact 25 of the resilient contact piece 23 is projected toward the one female terminal 12*a* through the bending space 17 and the through hole 31 to resiliently abut on the one female terminal 12*a*, and the contact piece 24 abuts on the other female connector 12*b* through the communicating hole 19. Thus, the short-circuit terminal 13 is received in the receiving part 37 and electrically connects the two female terminals 12*a*, 12*b*. Further, even in this state, because the widths W1, W2 are formed as before described, the other end 23*b* of the resilient contact piece 23 is not projected toward the terminal-receiving chamber 16 and positioned in the receiving part 37.

Thus, the assembled connector 3 is connected to the mating connector 2. When the connector 3 is connected to the mating connector 2, as shown in FIG. 2, the releasing piece 9 contacts the point of contact 25 without touching the other end 23*b* of the resilient contact piece 23, separates the point of contact 25 from the one female connector 12*a*, and cancels the electric connection between the female terminals 12*a*, 12*b*. Then, the male terminal is electrically connected to the female terminals 12*a*, 12*b*. Thus, the connector unit 1 connects the devices of the air bag.

When the connector unit 1 separates the connectors 2, 3, the releasing piece 9 no longer interferes with the resilient contact piece 23 before the electric contact between the male terminal 5 and the female terminals 12*a*, 12*b* is canceled, and the short-circuit terminal 13 electrically connects the two female terminals 12*a*, 12*b*. Thus, the connector unit 1 grounds the static electricity caused by friction between the male terminal and the one female terminal 12*a* when the connectors 2, 3 are separated. Thus, the connector unit 1 prevents the air bag from malfunctioning when the connectors 2, 3 are separated from each other.

According to the connector 3 of this embodiment, the contact regulating part 38 prevents the other end 23*b* of the resilient contact piece 23 from deforming to project toward the one female terminal 12*a*. Therefore, when the connector 3 is connected to the mating connector 2, the resilient contact piece 23 is prevented from being deformed until the other end 23*b* contacts the female terminal 12*a*. Therefore, when connected to the mating connector 2, the connector 3 surely cancels the connection between the short-circuit terminal 13 and the male terminal 12*a*.

Because the contact regulating part 38 includes the regulating part 39 which prevents the other end 23*b* of the resilient contact piece 23 from projecting toward the female terminal 12*a*, when the connector 3 is connected to the mating connector 2, the resilient contact piece 23 is surely prevented from contacting the female terminal 12*a*.

Because the regulating part 39 includes the regulating projections 40 projected from the other end 23*b* of the resilient contact piece 23 in the width direction H, the resilient contact piece 23 is surely prevented from contacting the female terminal 12*a*.

Because the resilient contact piece 23 of the short-circuit terminal 13 is disposed on the bending space 17 of the locking piece 18, there is no need for providing an additional space for the resilient contact piece 23 of the short-circuit terminal 13 in the connector housing 11. Therefore, the connector housing 11 and the connector 3 can be downsized.

Because the through hole 31 is provided at the regulating piece 29 of the front holder 14 for passing the resilient contact piece 23 of the short-circuit terminal 13, the interference between the regulating piece 29 and the short-circuit terminal 13 is prevented, the short-circuit terminal 13 surely connects the female terminals 12*a*, 12*b* to each other, and the connector housing 11 and the connector 3 can be prevented from being upsized.

Because the short-circuit terminal 13 is interposed between the two female terminals 12*a*, 12*b*, and the resilient contact piece 23 of the short-circuit terminal 13 contacts the female terminal 12*a* through the bending space 17, a space for the female terminals 12*a*, 12*b* can be reduced in comparison with arranging the short-circuit terminal 13 overlapped with the female terminals 12*a*, 12*b*. Therefore, the connector housing 11 and the connector 3 are surely prevented from being upsized.

According to the present embodiment, the short-circuit terminal 13 electrically connects the two female terminals 12*a*, 12*b* to each other. However, the present invention is not limited to the two female terminals 12*a*, 12*b*. The short-circuit terminal 13 may connect the various terminal fittings, for example, a male terminal fitting.

According to the present embodiment, the short-circuit terminal 13 connects the two female terminals 12*a*, 12*b* overlapped with each other in a thickness direction of the connector 3 (a direction perpendicular to both the connecting direction K and the width direction H). However, according to the present invention, the short-circuit terminal 13 may connect the two terminal fittings disposed parallel to each other in the width direction H of the connector 3 through the bending space 17 of the locking piece 18.

According to the present embodiment, the mating connector 2 cancels the connection between the short-circuit terminal 13 and the female terminal 12*a*, and the connection between the short-circuit terminal 13 and the female terminal 12*b* is maintained. However, according to the present invention, the connector 2 may cancel the both connection between the short-circuit terminal 13 and the female terminal 12*a*, and between the short-circuit terminal 13 and the female terminal 12*b*, or may cancel the connection between the short-circuit terminal 13 and the female terminal 12*b*, and the connection between the short-circuit terminal 13 and the female terminal 12*a* may be maintained. In short, according to the present invention, the connector 2 may cancel the connection between the short-circuit terminal 13 and at least one of the female terminals 12*a*, 12*b*.

According to the present invention, the connector 3 may include at least two of the female terminals 12, 12*a*, 12*b*. Further, according to the present invention, the regulating piece 29 having the through hole 31 may be provided at the connector housing 11 without providing the front holder 14. According to the present embodiment, the pair of regulating projections 40 is formed on the other end 23*b* of the resilient contact piece 23. However, according to the present invention, only one regulating projection 40 may be formed, or more than three of the regulating projections 40 may be formed. Further, according to the present invention, the regulating projections 40 may be mounted on an inner wall of the through hole 31 of the regulating piece 29.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A connector comprising:

at least two terminal fittings;

a connector housing having terminal-receiving chambers for receiving the terminal fittings; and a short-circuit terminal for electrically connecting the two terminal fittings to each other, wherein when the connector is connected to a mating connector, at least one of connections between the short-circuit terminal and the two terminal fittings is canceled, wherein the short-circuit terminal includes:

a fixed part to be fixed to the connector housing;

a resilient contact piece, one end of which is continued to the fixed part, and extended from the fixed part toward the mating connector, the other end of which is a free end and resiliently contacts one of the two terminal fittings; and a contact regulating part for preventing a deformation of the resilient contact piece so that the other end of the resilient contact piece is not projected toward the one of the terminal fittings.

2. The connector as claimed in claim 1, wherein the contact regulating part is formed in between the short-circuit terminal and the one terminal fitting, and includes a regulating piece having a through hole for allowing the center of the resilient contact piece to touch the one of the terminal fittings, and a regulating part for preventing the other end of the resilient contact piece from passing through the through hole and projecting from the regulating piece toward the one of the terminal fittings.

3. The connector as claimed in claim 2, wherein the regulating part is formed on the other end of the resilient contact piece, and includes regulating projections projected from the other end in a width direction of the resilient contact piece.

4. The connector as claimed in claim 2, further including a spacer attachable to and detachable from the connector housing, said spacer preventing the terminal fittings from falling out of the terminal-receiving chambers, and including the regulating piece.

5. The connector as claimed in claim 1, wherein the short-circuit terminal further includes a contact piece for contacting the other terminal fitting.

6. The connector as claimed in claim 1, wherein the short-circuit terminal is interposed between the two terminal fittings.

7. A connector unit comprising: a connector as claimed in any one of precedent claims; and a mating connector connected to the connector, and including a canceling part for canceling at least one of connections between the sort-circuit terminal and the two terminal fittings when the mating connector is connected to the connector.

* * * * *